US005163777A

United States Patent [19]

Krueger et al.

[11] Patent Number: 5,163,777

[45] Date of Patent: Nov. 17, 1992

[54] COBBLE STONE KIT

[75] Inventors: Ronald G. Krueger, Branchville; Arthur A. LaBouseur, Wantage, both of N.J.

[73] Assignee: Concrete Stone & Tile Corporation, Branchville, N.J.

[21] Appl. No.: 795,774

[22] Filed: Nov. 21, 1991

[51] Int. Cl.[5] ..... E01C 5/00

[52] U.S. Cl. ..... 404/41; 404/42

[58] Field of Search ..... 404/41, 42; 52/311

[56] References Cited

FOREIGN PATENT DOCUMENTS 2407621 8/1975 Fed. Rep. of Germany ..... 52/311

OTHER PUBLICATIONS

New Mathematical Pastimes, MacMahon, The MacMillan Co, 1921.

*Primary Examiner*—William P. Neuder

*Attorney, Agent, or Firm*—William T. Hough

[57] ABSTRACT

A kit of cobble stone elements of varied shapes which when fitted together into a close-fitting fan-shaped composite of which a plurality of the fan shaped composites symbolic of a fish scale form a close-fitting integrated repetitive design of unique and novel appearance.

36 Claims, 2 Drawing Sheets

COBBLE STONE KIT

This invention relates to a novel cobblestone kit that may be assembled into a patio or walk or road or wall surface embodying one or more meshing arcuately shaped fan like designs.

PRIOR ART

While a patentability novelty search was conducted in U.S. Patent and Trademark Office class 156, subclass 63, and class 52, subclass 315 and class 404, subclass 42, no relevent prior art was located. Patents of mere interest include: U.S. Pat. No. 4,907,909 issued on Mar. 13, 1990 to Ruckstuhl depicting varied irregularly shaped stone having four circumscribing sides as viewed when lying flatly, some having constant height and width. U.S. Pat. No. 1,812,711 issued Jun. 30, 1931 to Pissione directed to intermeshing squared cross-shaped members; U.S. Pat. No. 2,919,634 issued on Jan. 5, 1990 to Plotner depicting intermeshing linearly-extend rows of zig-zag or z shaped member having substantially parallel opposite face; and U.S. Pat. No. 4,973,192 issued Nov. 27, 1990 to Hair disclosing a variety of arcuate members having multiple convexly shaped humps with concavely-shaped bottom shaped.

BACKGROUND

Prior to the present invention, diverse composite designs composed of various irregularly shaped separate cobble stone elements have not heretofore been utilizable to obtain an integrated design inclusive of a plurality of fan shaped composites. Heretofore it has not been accomplished for any prior combination of different irregularly-shaped separate cobble-stone elements, that integrated fan shaped composites would fit together in a coordinated and close fitting relationship with other elements. In arriving at the present invention, applicant undertook and was required to conduct extensive expensive experimentation. During experimentation, there were a series of failure prior to arriving at the present invention.

OBJECTS OF THE INVENTION

Accordingly, objects of this invention include the obtaining of a kit composite or combination utilizable as an integrated composite of cobble stone-like elements of which the integrated composite is novelly shaped symbolic of a fish scale, integratable into a tight and neat composite design devoid of requirement of cuts and/or extra pieces, apart from linear edges of a walk, road or the like.

Another object is to attain such a form-shaped composite having unique shape characteristics, as a fan-shaped composite such that a plurality of the fan shaped composites are integratable into a close-fitting composite fish-scale design.

Another object is to obtain a kit combination of above-type of prior objects, of a nature such that a person having little or limited mechanical skill may easily correctly assemble the kit into a walk or drive or patio or driveway or the like.

Another object is to obtain the foregoing objects at a cost adapted to provide the kit at a commercially appealing price.

Another object is to obtain such a kit and composite thereof utilizing a plurality of differently novel shaped elements of specific shapes and numbers and rows thereof, to achieve the fish-scale design.

Another object is to obtain alternately uni-shaped or bilaterally shaped (mirror images) designs by the novel alternate kits of the present invention.

Other objects become apparent from the preceding and following disclosure.

BROAD DESCRIPTION

The kit includes a predetermined number of differently-shaped blocks (at least as to their upper faces) typically of concrete but not limited thereto, characterized as cobble stone-like appearance. The differently-shaped blocks when assembled integrally for a fan-shaped composite. The shape of the blocks are such that the curved or arcuate shape of the fan-shaped fish scale composite is utilizable as an integrated close-fitting composite fish scale design. While not imperative for the broad invention, at least one preferred embodiment is bi-lateral in appearance for the single composite. As set forth below, for the upwardly-extending sides extending between the bottom and top of the individual blocks, the often divided portions thereof diverging laterally at varying angles—hereinafter referred to as "angular" or "arcuate" side edges, are such that a plurality of single-composites are closely fitable into a close-fitting repetitive design of repeating fish-scale larger design that may repeatedly repeat over a large upper surface area of a driveway or road or patio or walk or side-face of a wall or the like.

Accordingly broadly the invention encompasses a novel kit or combination or composite of interrelated elements emulating cobble stone in the nature of that of the Roman era. The kit broadly includes a first plurality of cobble stone-like elements. The first plurality of cobble stone-like elements have upper faces and circumscribing peripheries of at least three different shapes of upper faces. The different shapes are of configurations integratable with one another into a close-fitting composite of the upper faces when integrated have a second circumscribing periphery of fan shape resembling a fish scale.

In a first preferred embodiment, there is included a second plurality of the close-fitting composite. The second circumscribing periphery has arcuate shapes such that the second plurality is integratable into a first close-fitting composite design.

In a second preferred embodiment as an improvement on the first preferred embodiment, the first plurality includes an apex element and a first row of first remaining others of the different shapes arrangable in series in integral close fitting contact with adjacent ones of the first plurality. Also, the first row is in integral close-fitting contact with the apex element.

In a third preferred embodiment as an improvement on the second preferred embodiment, there is included a third plurality of the close-fitting composite. In this embodiment, the circumscribing periphery has arcuate shapes such that the second and third pluralities are integratable into a second close-fitting composite design.

In a fourth preferred embodiment as an improvement on the third preferred embodiment, the first plurality includes a second row of second remaining others of the different shapes arrangeable in a series in integral close-fitting contact with adjacent ones of the second remaining others and with the first remaining others.

In a fifth preferred embodiment as an improvement on the fourth preferred embodiment, there is additionally included a fourth plurality of the close-fitting composite. The circumscribing periphery has arcuate shapes such that the second, third and fourth pluralities are integratable into a third close-fitting composite design.

In a sixth preferred embodiment as an improvement on the fifth preferred embodiment, the first plurality includes a third row of third remaining others of the different shapes arrangeable in series in integral close-fitting contact with adjacent ones of the third remaining others and with the second remaining others.

In a seventh preferred embodiment as an improvement on the sixth preferred embodiment, there is included a fifth plurality of the close-fitting composite. The circumscribing periphery has arcuate shapes such that the second, third, fourth and fifth pluralities are integratable into a fourth close-fitting composite design.

In an eighth preferred embodiment as an improvement on the seventh preferred embodiment, the first plurality includes a fourth row of fourth remaining others of the different shapes arranged in series in integral close-fitting contact with adjacent ones of the fourth remaining others and with the third remaining others.

In a ninth preferred embodiment as an improvement on the eighth preferred embodiment, there is included a sixth plurality of the close fitting composite the circumscribing periphery having arcuate shapes such that the second, third, fourth, fifth and sixth pluralities are integratable into a fifth close fitting composite design.

In a tenth preferred embodiment as an improvement on the ninth preferred embodiment, the first plurality includes a fifth row of fifth remaining others of the different shapes arrangeable in series in integral close-fitting contact with adjacent ones of the fifth remaining others and with the fourth remaining others.

In an eleventh preferred embodiment as an improvement on the tenth preferred embodiment, the first remaining others of the first row consist essentially of two differing shapes and the second remaining others of the second row consist essentially of three differing shapes and the third remaining others of the third row consist essentially of four differing shapes, and the fourth remaining others of the fourth row consist essentially of four differing shapes, and the fifth remaining others of the fifth row consist essentially of five differing shapes.

In a twelfth preferred embodiment as an improvement on the eleventh preferred embodiment, the first remaining others of the first row consist essentially of two differing shapes.

In a thirteenth preferred embodiment as an improvement on the twelfth preferred embodiment, the two differing shapes include at-least two small circle-creating elements having four upper-face circumscribing edges including opposite top and bottom parallel edges and diverging opposite sides. There is also included a central parallel element having four upper-face circumscribing rectangular edges.

In a fourteenth preferred embodiment as an improvement on the thirteenth preferred embodiment, the second remaining others of the second row consist essentially of three differing shapes.

In a fifteenth preferred embodiment as an improvement on the fourteenth preferred embodiment, the three differing shapes include one left-end element, one right-end element, and four large circle-forming elements, the left end element having four upper-face circumscribing edges including diverging opposite sides.

In a sixteenth preferred embodiment as an improvement on the fifteenth preferred embodiment, the third remaining others of the third row consist essentially of four differing shapes.

In a seventeenth preferred embodiment as an improvement on the sixteenth preferred embodiment, the four differing shapes include a small circle-forming rectangular element, a left-end element, a right-end element, and six large circle-forming elements including parallel opposite top and bottom edges and diverging opposite sides.

In an eighteenth preferred embodiment, as an improvement on the eighth preferred embodiment, the fourth remaining others of the fourth row consist essentially of four differing shapes.

In a nineteenth preferred embodiment as an improvement on the seventeenth preferred embodiment, the four differing shapes include two rectangular mini-circle-forming elements, and include nine large circle-forming elements including parallel opposite top and bottom edges and diverging opposite sides, and include a left-end element, and a right-end element.

In a twentieth preferred embodiment as an improvement on the tenth preferred embodiment, the fifth remaining others of the fifth row consist essentially of five differing shapes.

In a twenty-first preferred embodiment as an improvement on the twentieth preferred embodiment, the five differing shapes include two small circle-forming rectangular elements, six mini-circle-forming elements, and eight large circle-forming elements including parallel opposite top and bottom edges and diverging opposite sides, and a left end element and a right end element.

In a twenty-second preferred embodiment as an improvement on the second preferred embodiment, the apex element includes two upper and lower bottom edges and opposite diverging side edges. The upper edge includes opposite laterally extending slanted portions separated by a central portion with the central portion being parallel with the bottom edge, and each of the opposite diverging side edges include two serially consecutive linear portions of increasing divergence in moving from the lower bottom edge toward the upper top edge.

In a twenty-third preferred embodiment as an improvement on the thirteenth preferred embodiment, the first row includes a first and second end-ones of the remaining others, positioned at opposite ends of the first row as the two small circle-creating elements separated from one-another and in contact with the central small element intermeshing therewith.

In a twenty-fourth preferred embodiment as an improvement on the twenty-third preferred embodiment, the first plurality includes a second row of second remaining others of the different shapes arrangeable in a series in integral close-fitting contact with adjacent ones of the second remaining others and with the first remaining others, the second remaining others of the second row consists essentially of three differing shapes, the three differing shapes include one left-end element, one right-end element, and four large circle-forming elements, the left-end element has four upper-face circumscribing edges including diverging opposite sides, and the second row includes third and fourth end ones of the remaining others as the left and right-end elements positioned at opposite ends of the second row, the four large circle-forming elements being for serially arranging as a four-member series with first and second opposite ends, the four member series being positionable between the third and fourth end-ones of the remaining others with the first opposite end in contact with the third end-one and with the second opposite end-one in contact with the fourth end-one of the remaining others.

In a twenty-fifth preferred embodiment as an improvement on the twenty-fourth preferred embodiment, the first plurality includes a third row of third remaining others of the different shapes arrangeable in series in integral close-fitting contact with adjacent ones of the third remaining others and with the second remaining others. The third remaining others of the third row consist essentially of four differing shapes, the four differing shapes include a small circle-forming rectangular element, a left-end element, a right-end element, and six large circle-forming elements including parallel opposite top and bottom edges and diverging opposite sides, and the third row includes a fifth and sixth end-ones of the remaining others as additional ones of the left and right-end elements, positioned at opposite ends of the third rows, the sixth large circle-forming elements being for arranging as two series of three elements between the third and fourth end-ones, the two series being arranged to be separated by and in intermeshing contact with another one of the central circle-creating element and for one of the two series to be in contact with the fifth end-one, and for a remaining one of the two series to be in contact with the sixth end-one of the two series.

In a twenty-sixth preferred embodiment as an improvement on the twenty-fifth preferred embodiment, the first plurality includes a fourth row of four remaining others of the different shapes arrangeable in series in integral close-fitting contact with adjacent ones of the fourth remaining others and with the third remaining others. The fourth remaining others of the fourth row consist essentially of four differing shapes, the four differing shapes include two rectangular mini circle-forming elements, and there are included nine large circle-forming elements including parallel opposite top and bottom edges and diverging opposite sides, and additionally there are included a left-end element and a right-end element, and the fourth row includes seventh and eighth end-ones of the remaining others as additional ones of the ones of the left and right-end elements, positionable at opposite ends of the fourth row, one large circle forming element of the nine large circle forming elements being for positioning between and in meshing contact with the two mini-circle-forming elements, four of the nine large circle forming elements being for placing between and in meshing contact with the seventh end-one and one of the two mini-circle-forming elements, and a remaining four of the nine large circle-forming elements being for placing between and in making contact with a remaining one of the two mini circle-forming elements.

In a twenty-seventh preferred embodiment, the first plurality includes a fifth row of above-noted fifth remaining others of the different shapes arrangeable in series in integral close-fitting contact with adjacent ones of the above-noted fifth remaining others and with the above-noted fourth remaining others, the fifth remaining others of the fifth row consist essentially of five differing shapes. The five differing shapes include two small circle-forming rectangular elements, six mini-circle-forming elements, eight large circle-forming elements including parallel opposite top and bottom edges and diverging opposite sides, and a left-end element and a right-end element, and the fifth row includes ninth and tenth end-ones of the remaining others as additional ones of the left and right-end elements, positioned at opposite ends of the fifth row, the eight large circle-forming elements being for dividing into first and second series of large circle-forming elements, and for having alternate ones of the first series being for being separated by and being in intimate contact with one of others of the main circle forming elements, and a third series of two of the large circle forming elements being for spacing between and for being in contact with the first and second series, and the two of the large circle forming elements being for the series of two to be alternated with and in contact with others of the small circle forming elements.

In a twenty-eighth preferred embodiment of the invention, there is the novel combination assembled into the close-fitting composite of the above-described broad invention.

In a twenty-ninth preferred embodiment, there is the novel combination assembled into the close-fitting composite of the above-described first preferred embodiment in which the first plurality forms a sub-design repeated in said close-fitting composite.

In a thirtieth preferred embodiment, there is the novel combination assembled into the close-fitting composite of the above-described second preferred embodiment in which the first plurality forms a sub-design repeated in said close-fitting composite.

In a thirty-first preferred embodiment, there is the novel combination assembled into the close-fitting composite of the above-described third preferred embodiment in which the first plurality forms a sub-design repeated in said close-fitting composite.

In a thirty-second preferred embodiment, there is the novel combination assembled into the close-fitting composite of the above-described fourth preferred embodiment in which the first plurality forms a sub-design repeated in said close-fitting composite.

In a thirty-third preferred embodiment, there is the novel combination assembled into the close-fitting composite of the above-described fifth preferred embodiment in which the first plurality forms a sub-design repeated in said close-fitting composite.

In a thirty-fourth preferred embodiment, there is the novel combination assembled into the close-fitting composite of the above-described sixth preferred embodiment in which the first plurality forms a sub-design repeated in said close-fitting composite.

In a thirty-fifth preferred embodiment, there is the novel combination assembled into the close-fitting composite of the above-described twenty-seventh preferred embodiment in which the first plurality forms a sub-design repeated in said close-fitting composite.

The invention may be better understood by making reference to the following Figures.

THE FIGURES

FIG. 1 diagrammatically illustrates an in-part top plan view of a greater integrated composite combination of an integrated plurality of repeating sub-designs of a first plurality making up a close fitting composite of which the left half thereof is substantially a mirror image of the right half thereof.

FIG. 2 diagrammatically illustrates in top pan view a mono-design equaling and/or resembling solely one-half (here the left half) of the substantially bilaterally designed mirror-image sub-design illustrated in FIG. 1.

FIG. 3 diagrammatically illustrates a perspective view of the apex element (starter cobble) of the sub-design illustrated in FIG. 1, typically illustrating a representative thickness of this and other remaining cobble stone-like elements of the various embodiments of the present invention.

DETAILED DESCRIPTION

The invention in greater detail as represented by the foregoing Figures, may be described by the following identified elements and indicia thereof, indicia for common elements of different embodiments utilizing related indicia. Once described for one or more embodiments, common or related elements are not repeated in the identification thereof, except in certain instances to improve clarity and understanding.

Figure 1:
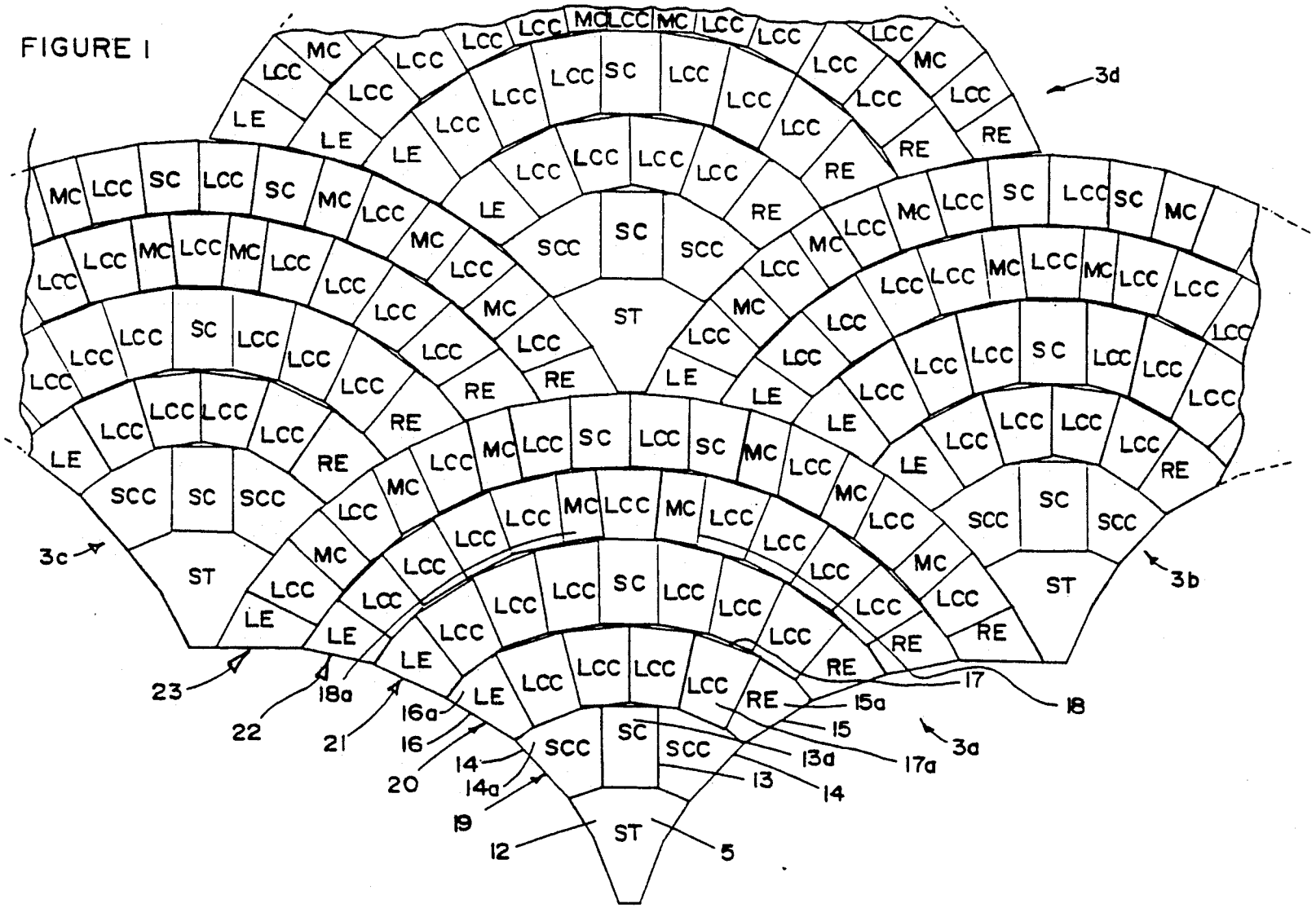

FIG. 1 illustrates both the separate sub-design as the close-fitting composite 3*a* of the previously described first plurality, also FIG. 1 illustration the greater integrated composite combination of integrated plurality of repeating sub-designs 3*b*, 3*c* and 3*d* integrated with the sub-design 3*a*.

In FIG. 1, characteristic elements making up each of the sub-design composites 3*a*, 3*b*, 3*c* and 3*d*, illustrates for the sub-design composite 3*a* all differently-shaped cobble stone-like elements making up a single sub-design composite of the FIG. 1 variety, as follows, each stone-like element (solely for purposes of facilitating improved understanding) bearing representative legends: the apex element (starter cobble stone-like element) 5—represented by ST, the upper face 12 of the apex stone-like element; the small cobble stone-like element 13—represented by SC having upper face 13*a*; small circle cobble stone-like elements 14—represented by SCC having upper face 14*a*; right end cobble stone-like element 15—represented by RE having upper face 15*a*; left end cobble stone-like element 16—represented by LE having upper face 16*a*; large circle cobble stone-like element 17—represented by LCC having upper face 17*a*; and mini cobble stone-like element 18—represented by MC having upper face 18*a*. The representative sub-design composite 3*a* has a first row 19 of serially positioned cobble stone-like elements, a second row 20 of a different combination of serially positioned cobble stone-like elements, a third row 21 of a still different combination of serially positioned cobble stone-like elements, a fourth row 22 of a still different combination of serially positioned cobble stone-like elements, and a fifth row 23 of a still different combination of serially positioned cobble stone-like elements.

It may be readily seen that each of the sub-design combinations 3*a*, 3*b*, 3*c* and 3*d* has a substantially (although not completely) bilateral appearance.

Figure 2:
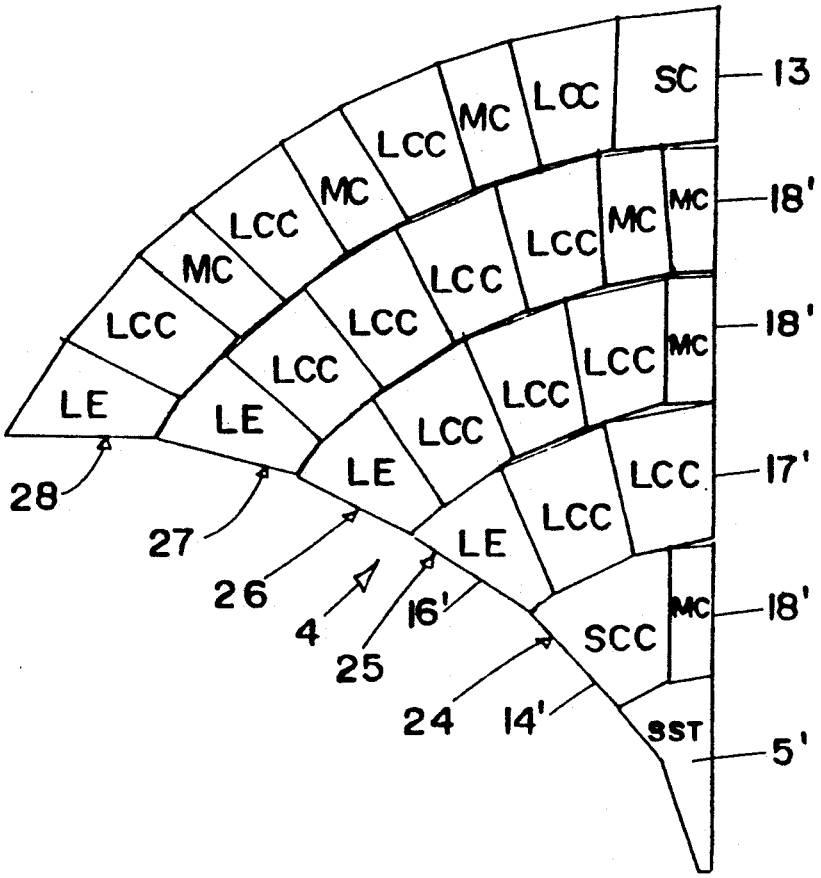

FIG. 2 illustrates a different sub-design combination having a mono-design nature and appearance embodying substantially the appearance of the left-half mirror-image of the bilaterally-appearing subcomposite of typically 3*a* of FIG. 1; the FIG. 2 embodiment utilizes a few variations, such as employing a first row 24 having its right cobble stone-like element 18'—represented by MC, and likewise for the right-end cobble stone-like elements of the third row 26 and the fourth row 27. The particular illustrated (as typically representative but not all-inclusive) sub-design combination has corresponding rows of serially arranged rows of various cobble stone-like element, namely first row 24, second row 25, third row 26, fourth row 27 and fifth row 28. The apex cobble stone-like element 5' corresponds to a left-half mirror image of the FIG. 1 sub-combination 3 apex cobble stone-like element 5. While solely for illustrative purposes a left-type mirror image has been illustrated for the embodiment of FIG. 2, the invention obviously also includes mono-subdesign combinations that are either left or right in nature and appearance and/or combinations thereof as an alternate design for that of sub-design composite combination 3*a*.

Figure 3:
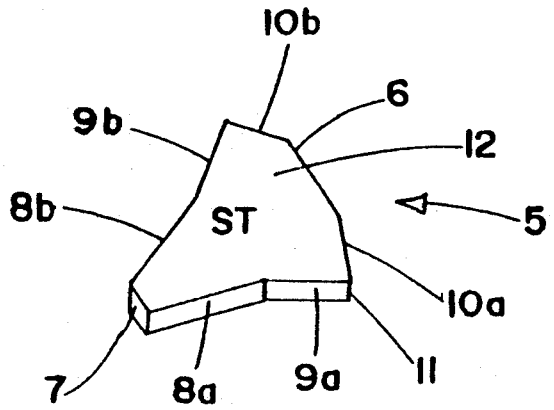

FIG. 3 illustrates the apex cobble stone-like element 5 of FIG. 1, but the descriptive features here represented equally apply to the embodiment of FIG. 2. Accordingly, FIG. 3 in perspective front and side and top views thereof, illustrated the element 5 with its top 12 and having its flat and linially-extending bottom face and edge thereof 7, it adjoining diverging opposite faces 8*a* and 8*b* and correspondingly-shaped upper edges thereof, the more-diverging continuous opposite faces 9*a* and 9*b* and correspondingly-shaped upper edges thereof, the linially-extending top edge 6 (and its correspondingly downwardly-extending side corresponding to the thickness-corner 11), and the other serially-continuing downwardly-slanted (toward the bottom edge) edges 10*a* and 10*b* also having the common thickness 11. The apex element of FIG. 2 has mono-designed dimensions corresponding to those of half of the bottom 7 and half of the top 6, and the same as the edges 8*b* and 9*b* and 10*b*.

Some of the features that make the resulting fishscale sub-design composite combination and appearance thereof unique, are as follow:

1. The right elipsoid is a mirror image of the left elipsoid;

2. The right elipsoid of a first one sub-design fishscale composite and the left elipsoid of a second sub-design fishscale composite integrated against and next to the first one fishscale composite, equal the total top of another subcombination fishscale composite installed below it;

3. The sub-design (pattern) is put together to form a unique individual shape of one fishscale. T.-p. The newly designed shapes also include the left and right-end cobble stone-like elements, as integral parts to the functionability of both the sub-design composite and the greater integrated design composite, as such right and left end elements form the edges of the radius and the ends of rows 3(+)—such as for rows 3, 4, 5, etc.

It is to be understood that the illustrated number of rows represent the above-identified preferred embodiments, but that the invention contemplates and includes utilization optionally of a lesser or a greater number of rows of the same basic elements of FIG. 1 and/or FIG. 2 and/or combinations thereof, following the spirit of the invention of appropriate arrangements thereof.

For one sub-design composite such as composite 3 above identified, the approximate coverage is typically between 9.5 and 10 square feet. Typically, each of the cobble stone-like elements has a thickness of 2 and ⅜ inches and typically is of stone, concrete or cement, but may be plastic or the like in-part or in whole. For a minicobble (MC designation), approximate surface-area coverage is 7.2 cobble stone elements per square foot, with approximate dimensions of 6 inches by 3 inches. For a small cobble stone-like element (SC designation), approximate surface area coverage is 4.8 pieces per square foot, with approximate dimensions of 6 inches by 4.5 inches. For the large cobble stone-like element (LCC designation), approximate surface-area coverage is 2.3 pieces per square foot, with approximate dimensions of 6 inches by 9 inches. All other cobble stone-like elements likewise typically have the height of about 6 inches. The LE (left-end) and RE (right end) and LCC (large circle) cobble stone-like elements each have opposite side (edges) upwardly-diverging outwardly each defining an angle as measured from a horizontal, of typically between about 77 and 85 degrees—typically about 82 degrees. The bilateral-design apex cobble stone-like element 5 (ST designation [starter cobble]) has an initial angle for its upwardly extending opposite walls (each as measured from a horizontal) of about 70 degrees to 74 degrees, typically about 72 degrees, and at a location along the diverging edges at about ⅔ of the height thereof, each increases to about 50 to about 55 degrees—typically about 52 degrees; dimensions for the mono-design apex cobble stone-like cobble 5' (designated SST [small starter cobble]), the angular dimensions typically correspond to those here given for the apex element 5 (ST designation).

As is conventional technology, while it is not imperative to anchor together and/or adhere together adjacent (tangential) edges and/or sides of the cobble stone-like elements of the present invention, normal and convention technology and practice of utilizing mortar-mix and/or cement-mix and/or concrete-mix and/or synthetic and/or non-synthetic adhesive and/or binders or equivalent compositions, is contemplated for the present invention, and is within the scope and skill of the ordinary artisan of this particular technology—not requiring exhaustive descriptive of the laying of a combination of such elements as above-illustrated in the form of a road or walk or patio or wall or the like.

The cobble stone-like elements of the present invention may be any one or more of actual stone shaped to the illustrated shapes, and/or in-part or whole shaped concrete and/or cement and/or plastic and/or other appropriate composition, and/or combination(s) thereof.

It is likewise within the scope of the present invention to make such variations and/or modifications and/or substitution of equivalents as would be apparent to a person of ordinary skill in this particular art.

I claim:

1. A kit comprising in combination: a first plurality of cobble stone-like elements having upper faces, said first plurality of cobble stone-like elements having first circumscribing peripheries of at least three different shapes of upper faces, said different shapes being of configurations integratable with one another into a close-fitting composite of said upper faces of which said close fitting composite of said upper faces when integrated has a second circumscribing periphery of fan shape resembling a fish scale.

2. The kit of claim 1, including a second plurality of second cobble stone-like elements having upper faces, said second plurality having second circumscribing peripheries having arcuate shapes such that said second plurality is integratable with said close-fitting composite into another close-fitting composite design.

3. The kit of claim 2, in which said first plurality includes an apex element and a first row of first remaining others of said different shapes arrangeable in series in integral close fitting contact with adjacent ones of said first plurality and said first row being in integral close-fitting contact with said apex element.

4. The kit of claim 3, including a third plurality of third cobble stone-like elements having upper faces, said third plurality having third circumscribing peripheries having arcuate shapes such that said second and third pluralities are integratable with said close-fitting composite into another close-fitting composite design.

5. The kit of claim 4, in which said first plurality additionally includes a second row of second remaining others of said different shapes arrangeable in series in integral close-fitting contact with adjacent ones of said second remaining others and with said first remaining others.

6. The kit of claim 5, including a fourth plurality of fourth cobble stone-like elements having upper faces, said fourth plurality having fourth circumscribing peripheries having arcuate shapes such that said second, third and fourth pluralities are integratable with said close-fitting composite into another close-fitting composite design.

7. The kit of claim 6, in which said first plurality additionally includes a third row of third remaining others of said different shapes arrangeable in series in integral close-fitting contact with adjacent ones of said third remaining others and with said second remaining others.

8. The kit of claim 7, including a fifth plurality of fifth cobble stone-like elements having upper faces, said fifth plurality having fifth circumscribing peripheries having arcuate shapes such that said second, third, fourth and fifth pluralities are integratable with said close-fitting composite into another close-fitting composite design.

9. The kit of claim 8, in which said first plurality additionally includes a fourth row of fourth remaining others of said different shapes arranged in series in integral close-fitting contact with adjacent ones of said fourth remaining others and with said third remaining others.

10. The kit of claim 9, including a sixth plurality of sixth cobble stone-like elements having upper faces, said sixth plurality having sixth circumscribing peripheries having arcuate shapes such that said second, third, fourth, fifth and sixth plurality is integratable with said close-fitting composite into another close-fitting composite design.

11. The kit of claim 10, in which said first plurality additionally includes a fifth row of fifth remaining others of said different shapes arrangeable in series in integral close-fitting contact with adjacent ones of said fifth remaining others and with said fourth remaining others.

12. The kit of claim 11, in which said first remaining others of said first row consist essentially of two differing shapes and said second remaining others of said second row consist essentially of three differing shapes and said third remaining others of said third row consist essentially of four differing shapes, and said fourth remaining others of said fourth row consist essentially of four differing shapes, and said fifth remaining others of said fifth row consist essentially of five differing shapes.

13. The kit of claim 3, in which said first remaining others of said first row consist essentially of two differing shapes.

14. The kit of claim 13, in which said two differing shapes include at-least two small circle-creating elements having four upper-face circumscribing edges including opposite top and bottom parallel edges and diverging opposite sides, and includes a central parallel element having four upper-face circumscribing rectangular edges.

15. The kit of claim 5, in which said second remaining others of said second row consist essentially of three differing shapes.

16. The kit of claim 15, in which said three differing shapes include one left-end element, one right-end element, and four large circle-forming elements, said left-end element having four upper-face circumscribing edges including diverging opposite sides.

17. The kit of claim 7, in which said third remaining others of said third row consist essentially of four differing shapes.

18. The kit of claim 17, in which said four differing shapes include a small circle-forming rectangular element, and a left-end element, a right-end element, and six large circle-forming elements including parallel opposite top and bottom edges and diverging opposite sides.

19. The kit of claim 9, in which said fourth remaining others of said fourth row consist essentially of four differing shapes.

20. The kit of claim 18, in which said four differing shapes include two rectangular mini-circle-forming elements, and include nine large circle-forming elements including parallel opposite top and bottom edges and diverging opposite sides, and include a left-end element and a right-end element.

21. The kit of claim 11, in which said fifth remaining others of said fifth row consists essentially of five differing shapes.

22. The kit of claim 21, in which said five differing shapes include two small circle-forming rectangular elements, six mini-circle-forming elements, and eight large circle-forming elements including parallel opposite top and bottom edges and diverging opposite sides, and a left-end element and a right-end element.

23. The kit of claim 3, in which said apex element includes two upper and lower bottom edges and opposite diverging side edges, said upper edge includes opposite laterally extending slanted portions separated by a central portion with said central portion being parallel with said bottom edge, and each of said opposite diverging side edges include two serially consecutive linear portions of increasing divergence in moving from said lower bottom edge toward said upper top edge.

24. The kit of claim 14, in which said first row includes first and second end-ones of said remaining others, positioned at opposite ends of said first row as said two small circle-creating elements separated from one another and in contact with said central small element intermeshing therewith.

25. The kit of claim 24, in which said first plurality includes a second row of second remaining others of said different shapes arrangeable in series in integral close-fitting contact with adjacent ones of said second remaining others and with said first remaining others, in which said second remaining others of said second row consist essentially of three differing shapes, in which said three differing shapes include one left-end element, one right-end element, and four large circle-forming elements, said left end element having four upper-face circumscribing edges including diverging opposite sides, and in which said second row includes third and fourth end ones of said remaining others as said left and right-end elements positioned at opposite ends of said second row, said four large circle-forming elements being for serially arranging as a four-member series with first and second opposite ends, said four member series being positioned between said third and fourth end-ones of said remaining others with said first opposite end in contact with said third end-one and with said second opposite end-one in contact with said fourth end-one of said remaining others.

26. The kit of claim 25, in which said first plurality additionally includes a third row of third remaining others of said different shapes arrangeable in series in integral close-fitting contact with adjacent ones of said third remaining others and with said second remaining others, in which said third remaining others of said third row consist essentially of four differing shapes, in which said four differing shapes include a small circle-forming rectangular element, and a left-end element, a right-end element, and six large circle-forming elements including parallel opposite top and bottom edges and diverging opposite sides, and in which said third row includes a fifth and sixth end-ones of said remaining others as additional ones of said left and right-end elements, positioned at opposite ends of said third rows, said sixth large circle-forming elements being for arranging as two series of three elements between said third and fourth end-ones, said two series being arrangement to be separated by and in intermeshing contact with another one of said central circle-creating element, and for one of said two series to be in contact with said fifth end-one, and for a remaining one of said two series to be in contact with said sixth end-one of said two series.

27. The kit of claim 26, in which said first plurality additionally includes a fourth row of fourth remaining others of said different shapes arrangeable in series in integral close-fitting contact with adjacent ones of said fourth remaining others and with said third remaining others, in which said fourth remaining others of said fourth row consist essentially of four differing shapes, in which said four differing shapes include two rectangular mini circle-forming elements, and include nine large circle-forming elements including parallel opposite top and bottom edges and diverging opposite sides, and include a left-end element, and a right-end element, and in which said fourth row includes seventh and eighth end-ones of said remaining others as additional ones of said ones of said left and right and elements, positioned at opposite ends of said fourth row, one large circle forming element of said nine large circle forming element being for positioning between and in meshing contact with said two mini-circle-forming element, four of said nine large circle forming elements being for placing between and in meshing contact with said seventh end-one and one of said two mini-circle-forming elements, and a remaining four of said nine large circle-forming elements being for placing between and in making contact with a remaining one of said two mini circle-forming elements.

28. The kit of claim 27, in which said first plurality additionally includes a fifth row of fifth remaining others of said different shapes arrangeable in series in integral close-fitting contact with adjacent ones of said fifth remaining others and with said fourth remaining others, in which said fifth remaining others of said fifth row consists essentially of five differing shapes, in which said five differing shapes include two small circle-forming rectangular elements, six mini-circle-forming elements, and eight large circle-forming elements including parallel opposite top and bottom edges and diverging opposite sides, and a left end element and a right end element, and in which said fifth row includes ninth and tenth end-ones of said remaining others as additional ones of said left and right end elements, positioned at opposite ends of said fifth row, said eight large circles-forming elements being for dividing into first and second series of large circle-forming elements, and for having alternate ones of said first series being for being separated by and being in intimate contact with one of others of said main circle forming elements, and a third series of two of said large circle forming elements being for spacing between and for being in contact with said first and second series, and said two of said large circle forming elements being for said series of two to be alternated with and in contact with others of said small circle forming elements.

29. A cobble stone-like combination comprising a close-fitting composite of cobble stone-like elements having tangential adjacent sides with one another in accord with the kit of claim 1.

30. A cobble stone-like combination comprising a close-fitting composite of cobble stone-like elements having tangential adjacent sides with one another in accord with the kit of claim 2.

31. A cobble stone-like combination comprising a close-fitting composite of cobble stone-like elements having tangential adjacent sides with one another in accord with the kit of claim 3.

32. A cobble stone-like combination comprising a close-fitting composite of cobble stone-like elements having tangential adjacent sides with one another in accord with the kit of claim 4.

33. A cobble stone-like combination comprising a close-fitting composite of cobble stone-like elements having tangential adjacent sides with one another in accord with the kit of claim 5.

34. A cobble stone-like combination comprising a close-fitting composite of cobble stone-like elements having tangential adjacent sides with one another in accord with the kit of claim 6.

35. A cobble stone-like combination comprising a close-fitting composite of cobble stone-like elements having tangential adjacent sides with one another in accord with the kit of claim 7.

36. A cobble stone-like combination comprising a close-fitting composite of cobble stone-like elements having tangential adjacent sides with one another in accord with the kit of claim 28.

* * * * *